United States Patent [19]

Reavis, Jr. et al.

[11] 4,141,618

[45] Feb. 27, 1979

[54] TRANSVERSELY SLOTTED BARREL TERMINAL

[75] Inventors: Robert P. Reavis, Jr., Statesville; Melvin A. Soderstrom, Advance; Vasantrai A. Vachhani, Kernersville, all of N.C.

[73] Assignee: AMP Incorporated, Harrisburg, Pa.

[21] Appl. No.: 857,068

[22] Filed: Dec. 5, 1977

[51] Int. Cl.[2] ..... H01R 9/08

[52] U.S. Cl. ..... 339/97 P

[58] Field of Search ..... 339/97 R, 97 P, 98, 339/99 R, 258 RR

[56] References Cited

U.S. PATENT DOCUMENTS

| | | | |
|---|---|---|---|
| 3,845,455 | 10/1974 | Shoemaker | 339/97 R |
| 3,860,318 | 1/1975 | Reavis, Jr. et al. | 339/99 R |
| 3,877,773 | 4/1975 | Doty et al. | 339/97 P |

FOREIGN PATENT DOCUMENTS

| | | | |
|---|---|---|---|
| 1640633 | 10/1969 | Fed. Rep. of Germany | 339/97 R |

*Primary Examiner*—Joseph H. McGlynn
*Attorney, Agent, or Firm*—Gerald K. Kita

[57] ABSTRACT

The disclosure relates to a metal plate terminal rolled into a barrel configuration having a longitudinal open seam defining a wire receiving slot. The terminal defines wire gripping jaws on either side of the seam. A transverse slot intersects the open seam dividing the jaws into two tandem pairs. An enlarged flared entryway is provided in the second pair of jaws for the open seam. The first set of jaws have tab portions projecting toward the second pair of jaws for guiding a wire along the open seam from the first set of jaws to the second. The transverse slot is of substantial width to prevent abrasion of the jaws with one another. The transverse slot further is of arcuate configuration, perpendicularly intersecting the open seam and incising one-fourth of a circumference of said barrel configuration on either side of said open seam.

7 Claims, 8 Drawing Figures

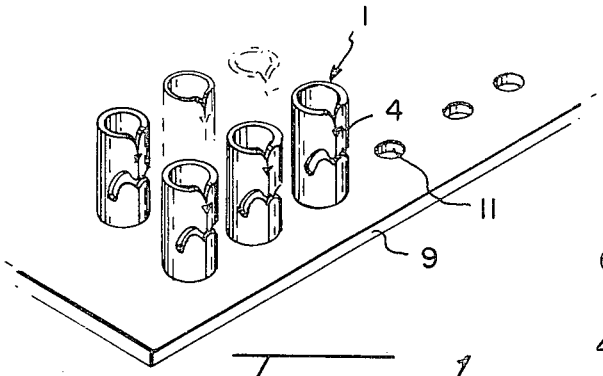
FIG. 1
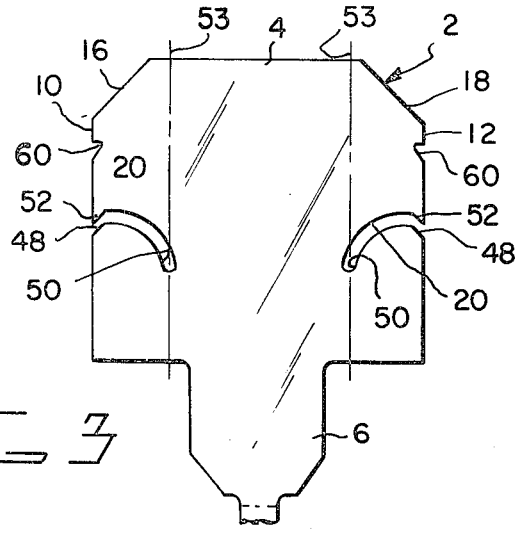
FIG. 3
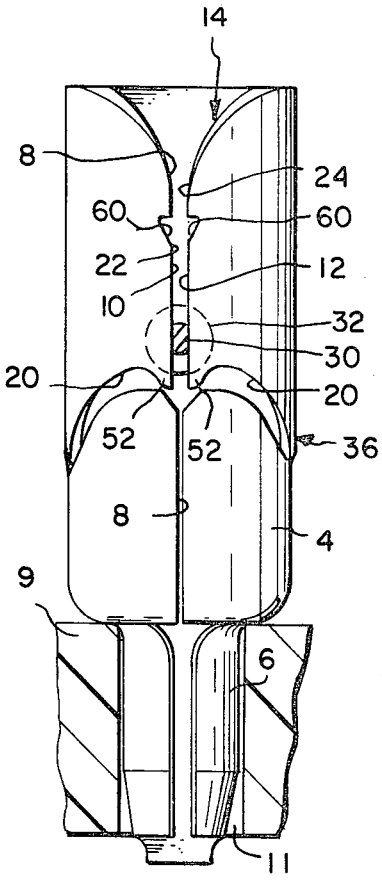
FIG. 2
FIG. 4
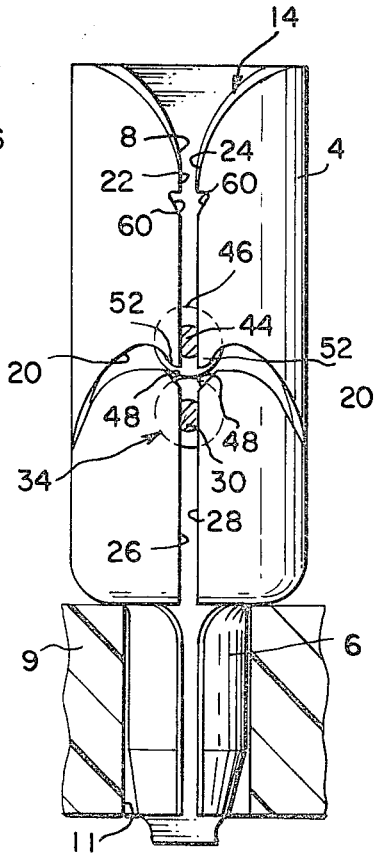
FIG. 5
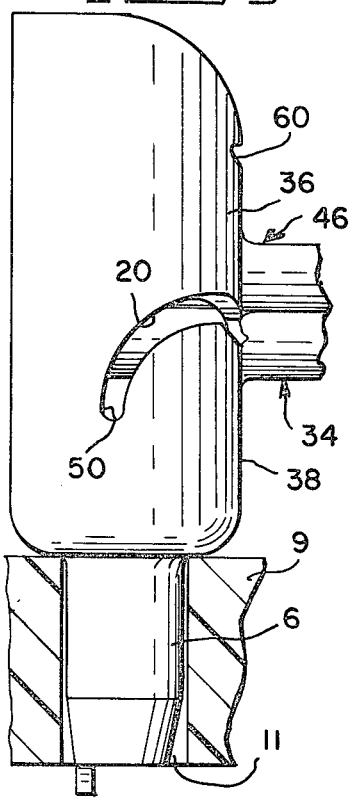

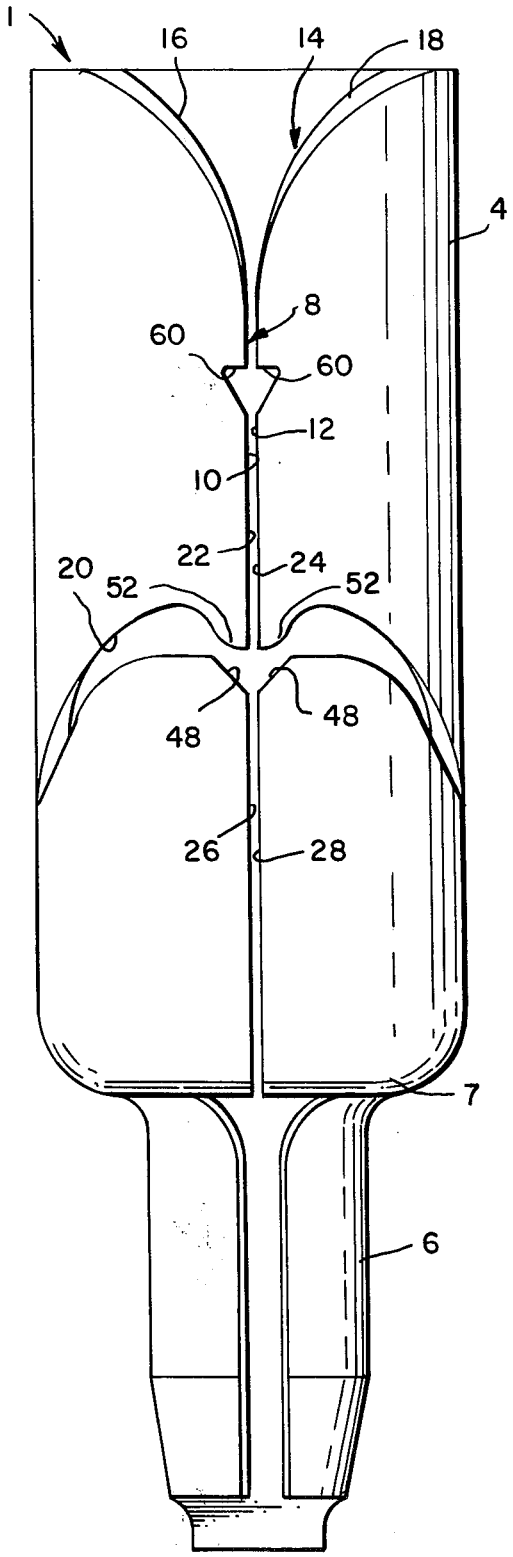
FIG. 6
FIG. 7
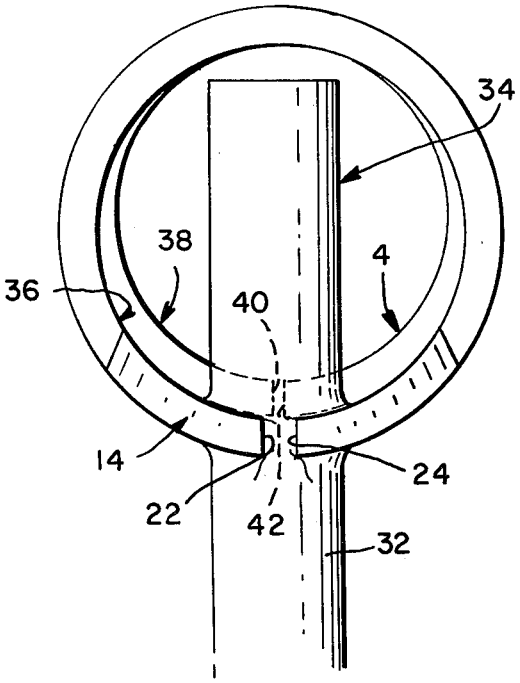
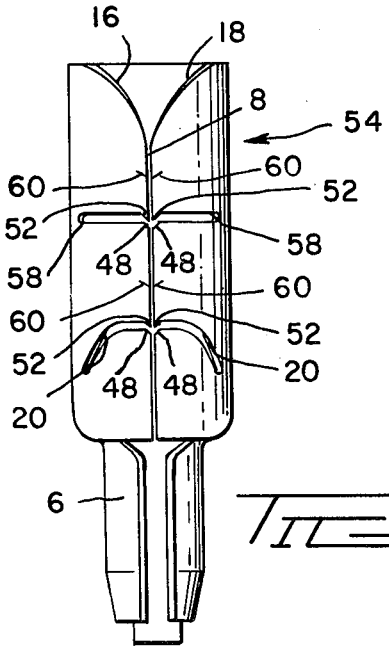
FIG. 8

TRANSVERSELY SLOTTED BARREL TERMINAL

BACKGROUND OF THE INVENTION

Transversely slotted barrel terminals are disclosed in each of U.S. Pat. Nos. 3,877,773 and 3,845,455. Each barrel terminal has a longitudinal, wire receiving, open seam. Wire gripping jaws are defined on either side of the open seam with slicing edges on the jaws so constructed and arranged to slice through an insulation jacket on the wire. Each terminal includes a transverse shear intersecting the open seam thereby providing two sets of tandem jaws which grip one of a pair of inserted wires. In each barrel of the disclosed patents the transverse slot is straight and perpendicular to the open seam. Thus each set of jaws provides the same gripping force on either side of the transverse slot. As a result, a wire which traverses the open seam from one set of jaws to the other must forcibly wedge apart the tandem set of jaws after having wedged apart the first set of jaws. Accordingly, the wire may be damaged after having wedged apart both sets of jaws.

U.S. Pat. No. 3,860,318 discloses a barrel terminal wherein a transverse slot thereof is straight and diagonally intersects the open seam providing narrow tips on the tandem set of jaws. When a wire is transferred from the first set of jaws from the second set of jaws, the wire will initially wedge apart the reduced tips of the jaws. Due to the reduced gripping pressure of the jaw tips, damage to the wire is alleviated.

In each of the transversely slotted barrel terminals disclosed in the prior art, the transverse slot is produced by a thin shear. Thinness in the shear has heretofore been necessary to prevent jamming of a wire in the transverse slot as the wire must pass the transverse slot when moving from one set of jaws to the other. Also, since the jaws are separated only by a shear line they tend to abrade against one another and therefore fail to act independently of one another when gripping a wire. It is therefore difficult to predict accurately the gripping pressure on wires inserted between corresponding sets of jaws. The integrity of the electrical connection of the wires with the barrel shaped terminal is adversely affected by such abrasion. However, to enlarge the width of the transverse slot would tend to allow jamming of a wire therein.

In each of the transversely slotted barrel terminals disclosed in the prior art an inserted wire which is transferred from the first set of wire gripping jaws to the tandem set of jaws must forcibly wedge apart the tandem set of jaws. This requirement is more readily accomplished by a solid diameter wire. However, for multi-stranded wire, commonly referred to in the art as stranded wire, some of the individual strands are broken as the wire wedges apart the tandem set of jaws.

BRIEF DESCRIPTION OF THE PREFERRED EMBODIMENT

The present invention relates to a barrel terminal which fulfills a long existing need for a transversely slotted barrel terminal whereby tandem sets of wire gripping jaws of the terminal operate independently without abrasion between the sets of jaws. The invention further fulfills the need for a terminal having tandem sets of wire gripping jaws suitable for use with stranded wire as well as solid wire. The invention further fulfills the need for a barrel terminal which is transversely slotted to provide tandem sets of wire gripping jaws so constructed and arranged to permit transfer of the wire from one set of jaws to the other without jamming in a transverse slot despite a relatively wide open width thereof.

The terminal according to the present invention includes a metal plate stamped and formed into a barrel configuration wherein a transverse slot of arcuate configuration perpendicularly intersects a wire receiving longitudinal open seam in order to prevent reduced tips on a tandem set of jaws with consequent weakening of the same. The arcuate shape, however, provides a slight tapering of the tandem set of jaws to provide a reduced gripping pressure on a wire which forcibly separates the tandem set of jaws after having previously spread apart a prior set of jaws. The transverse slot incises as much as one-fourth of the circumference of the barrel configuration on each side of the seam and terminates along tangent lines longitudinally of the barrel configuration, thereby maximizing metal areas and strength on either side of the transverse slot and also in the tandem set of jaws. The slot also may terminate before reaching the tangent lines, in which case the slot will incise less than one-fourth of the barrel circumference on either side of the seam. The tandem set of jaws will thereby provide a stronger grip on an inserted wire. The gripping force will be more dependent upon transfer of spring forces along the barrel from the first set of jaws to the tandem set of jaws, since the tandem set of jaws will be separated from the barrel by a slot which incises less than one-fourth of the barrel circumference. The transverse slot further is of substantial width to prevent abrasion of the jaws on either side of the slot. Any number of transverse slots may be provided to produce additional sets of tandem jaws. To prevent jamming of a wire in the substantially wide slot, each set of foremost jaws is provided with relatively narrow tabs on either side of the wire receiving seam which tabs project toward a tandem set of jaws and into the transverse slot. The tabs guide and laterally support opposite sides of a wire traversed through the transverse slot from the foremost set of jaws to a tandem set. In addition, each tandem set of jaws is provided with an enlarged flared entryway into which the tab portions project. The flared entryway tends to gether together individual strands of a stranded wire transferred from the foremost set of jaws into the tandem set.

It is therefore an object of the present invention to provide a barrel terminal having one or more transverse slots, each of sufficient width to prevent abrasion of the sets of wire gripping jaws on either side of each transverse slot, thus providing and maintaining independency between two or more wires terminated into the longitudinal slot.

Another object of the present invention is to provide a transversely slotted barrel terminal wherein the transverse slot is of relatively large width and wherein a foremost set of jaws includes a relatively thin projecting portion on each jaw which projects into the slot and toward a tandem set of jaws for guiding and supporting an end wire for traverse of the wire along a longitudinal open seam between the foremost set of jaws to the tandem set of jaws without jamming in the transverse slot.

Another object of the present invention is to provide a transversely slotted barrel terminal having one or more tandem sets of wire gripping jaws for gripping corresponding wires inserted along a longitudinal open seam of the barrel, whereby each set of tandem jaws includes a flared enlarged entryway for the longitudinal seam, and wherein each foremost set of jaws includes tab portions on the jaws projecting into the corresponding transverse slot and into a corresponding entryway of a tandem set of jaws to guide a wire from the foremost set of jaws into the entryway and between the tandem set of jaws.

Another object of the present invention is to provide a transversely slotted barrel terminal in which each transverse slot thereof is generally of arcuate configuration intersecting perpendicularly a longitudinal, wire receiving, open seam, and wherein ends of each transverse slot terminate along first and second tangent lines longitudinally of said barrel, said tangent lines being diametrically opposed on said barrel configuration whereby each said tangent line is bounded on either side by approximately one-fourth of the circumference of said barrel configuration for maximizing the strength of the barrel adjacent the terminal ends of said slot and adjacent corresponding tandem sets of jaws.

Other objects and many attendant advantages of the present invention will become apparent to one having ordinary skill in the art from the following detailed description taken in conjunction with the drawings wherein:

FIG. 1 is an enlarged fragmentary perspective of an apertured substrate into which a plurality of transversely slotted terminals according to the present invention are mounted.

FIG. 2 is an enlarged elevation of a preferred embodiment of the transversely slotted barrel terminal according to the present invention illustrating one wire inserted between a foremost pair of wire gripping jaws.

FIG. 3 is a stamped metal blank of the terminal according to the present invention prior to being formed into the barrel configuration.

FIG. 4 is an enlarged elevation similar to FIG. 3 illustrating two pairs of wire gripping jaws each having a corresponding wire inserted therebetween.

FIG. 5 is a side elevation of the terminal as illustrated in FIG. 4.

FIG. 6 is an enlarged front elevation of a terminal according to the present invention which is formed from the blank illustrated in FIG. 3.

FIG. 7 is an enlarged top plan view of the terminal shown in FIG. 2 with one inserted wire therein.

FIG. 8 is an enlarged elevation of a modified preferred embodiment.

DETAILED DESCRIPTION

With more particular reference to the drawings shown generally at 1 in FIG. 6 is a preferred embodiment of a barrel terminal.

The metal blank for the terminal 1 is more particularly illustrated at 2 in FIG. 3. The blank includes an upper section 4 and a lower reduced section 6. When the terminal is rolled up into a barrel configuration, the upper portion 4 will form an elongated, enlarged diameter barrel portion of the terminal as shown in FIG. 6. The section 6 will be rolled into a reduced diameter sleeve which is coaxial and intengral with the barrel section 4. An inverted shoulder 7 is provided as a stepped diameter intersection of the portions 4 and 6. As shown in FIG. 1, one or more of the terminals 1 may be mounted in a substrate 9 which is apertured at 11. Each of the sleeve portions 6 is mounted in a corresponding aperture 11 with a shoulder portion 7 of the terminal being seated against the surface of the substrate 9, whereby the terminal 1 has the barrel portion 4 mounted in projecting relationship from the substrate 9. FIGS. 3 and 6 further illustrate that the terminal 1 includes an open seam 8 longitudinally of the barrel portion 4. The open seam 8 is formed by relatively closely spaced edge margins 10 and 12 of the blank 2. A flared entryway 14 of the terminal 1 is formed by diagonally extending edge margins 16, 18 respectively, initially appearing as straight lines in the blank 2, but which appear in elevation in FIG. 6 as being arcuate, since the plane of the blank 2 is arcuately curved into a barrel configuration.

The blank 2 further is provided with a pair of mutually similar slot sections 20 which are arcuate and which intersect the side margins 10 and 12 approximately midway of their lengths. As shown in FIG. 6, the slot sections 20 are directly opposite each other in the barrel configuration and are generally tangent to an imaginary line perpendicular to the edge margins 10 and 12. Thereby, the slot sections are perpendicular to the longitudinal open seam 8. The slot sections 20 cooperate together to provide a single continuous slot transversely perpendicular to the open seam 8 dividing the edge margins 10 and 12 into a first pair of wire gripping jaws 22 and 24, and a second pair of wire gripping jaws 26 and 28 arranged tandemly along the longitudinal open seam 8. If desired to provide additional tandem sets of jaws, then additional transverse slots similar to the slot sections 20 may be provided along the length of the barrel 4. No matter how many sets of jaws are in fact provided there will always be a foremost set of jaws and a tandem set of jaws separated by a corresponding one of the transverse slots.

The terminal 1 is useful for electrical connection or electrical termination of one or more insulation covered wires. More particularly as shown in FIGS. 2 and 7, a foremost set of jaws, in this case the jaws 22 and 24, grippingly engage opposite sides of a wire conductor 30 which is encircled by an insulation jacket 32. More particularly, the conductor 30 and insulation 32 together comprises an insulated wire, the end portion 34 of which shown in FIG. 7 is inserted laterally into the flared entryway 14 and forcibly vertically downward through the open seam 8 in registration within the seam 8 in spaced relationship from the transverse slot provided by the slot sections 20. The wire gripping jaws 22 and 24 are provided with sharp edges which slice through the insulation 32 as the wire is forced between the jaws and slidably traversed along a substantial length of the edge margins 10 and 12 of the jaws. In the terminal 1, the foremost set of jaws also comprises the first set of jaws adjacent the flared entryway 14. This first set of jaws is on a section of the barrel 4 which is uninterripted by any slot portions about its circumference on either side of the wire receiving seam 8. Accordingly, a maximum resilient spring force of the barrel results, providing substantial gripping pressure on either side of the inserted wire 30, which pressure additionally is used for slicing through the insulation layer 32. The presence of the wire 30 between jaws 22 and 24 radially expands portions of the barrel as shown more particularly at 36 in FIGS. 2 and 7. A remainder portion of the barrel section which is separated from the jaws 22 and 24 by the slot sections 20 is of smaller radial dimension as shown at 38 in FIG. 7. The widths of the slot sections 20 are sufficient to allow radial expansion of the jaws 22 and 24 without abraiding the remainder of the terminal adjacent the slot sections 20.

As shown more particularly in FIG. 4 the tandem set or pair of jaws 26 and 28 are provided, the slot sections 20 separating or dividing the barrel portion 4 into tandem pairs or sets of wire gripping jaws. In the embodiment shown, the set of jaws 40 and 42 are tandem with respect to the foremost jaws 22 and 24 which also are the initial or first set of jaws adjacent to the flared entryway 14 at the beginning end of the barrel section 4. If additional slot sections are provided in the terminal along the barrel portion 4, additional sets of tandem jaw sections will follow the jaws 26 and 28 in which case the jaws 26 and 28 will be foremost with respect to such tandem jaws.

Each pair of jaw sections are provided to grip a separate wire therebetween. More particularly, in FIG. 4, there is shown a second insulated wire 46 which is inserted laterally along the open seam 8. The jaws 22 and 24 slice through the insulation jacket on the wire 46 and grippingly engage opposite sides of the central conductor 44 therein. The conductor 44 thereby is electrically terminated to the jaws 22 and 24. The initial wire 34 is engaged by the wire 46 and is urged thereby along the open seam 8 where it is transferred from the foremost jaws 22 and 24 to the tandem jaws 26 and 28 which grippingly engage opposite sides of the conductor 30 electrically terminating the same. The jaws 26 and 28 also are separated slightly by the presence of the conductor 30 therebetween. The portion of the barrel as shown at 38 in FIG. 7 thereby becomes radially expanded to the dimensions approximately that of the portion 36. Due to the substantial open width of the slot provided by the slot sections 20 the tandem jaws 26 and 28 radially expand and provide resilient gripping action on the inserted conductor 30 without abraiding the jaw sections 22 and 24 on the opposite side of the slot sections 20. Thereby, each set of tandem jaws is free to operate independently of the other providing predictable gripping pressure on the corresponding inserted wires as well as adequate electrical contact therewith.

As the wire 30 is urged or transferred from the foremost set of jaws to the tandem set of jaws past the slot provided by the slot sections 20, the wire 30 initially registers within a flared entryway on the tandem set of jaws provided by diagonal relieved portions 48. The flared entryway provides a funneling effect on the wire 30 allowing its introduction between the jaws 26 and 28 without undue damage thereto as the wire wedgingly separates the jaws 40 and 42 apart. The funnel entryway further tends to gather individual strands of the conductor 30 if it is a stranded conductor instead of a solid conductor. The gathering effect prevents shearing of individual strands as well as reduces the initial insertion force required to begin separation of the jaws 26 and 28. Slot sections 20 are arcuate intending to reduce the metal areas on either side of the jaws 26 and 28. Such reduction of metal provides a lower resilient gripping force on the inserted wire 30. Since the wire 30 initially has the insulation 32 thereof sliced through by the foremost jaws 22 and 24, slicing of the insulation a second time is not necessary. Less gripping forces are thereby required for the tandem jaws to establish electrical contact with the wire. Since less gripping forces are provided by the jaws 26 and 28, they are easily separated and radially expanded to the approximate radial dimensions of the barrel portion 36. The jaw portions 26 and 28 will freely enter through the insulation layer, which has been already sliced through by the foremost jaws 22 and 24, in order to grippingly engage opposite sides of the conductor 30. The relatively less gripping force of the jaws 26 and 28 are adequate for sufficient electrical gripping engagement on the inserted conductor 30. Slot sections 20 must intersect the longitudinal open seam 8 by an imaginary line perpendicular thereto in order to prevent an inordinate tapering and thereby weakening of the jaw sections 26 and 28 adjacent the flared entryway portions 48. Thus the transverse slot being perpendicular as described provides a relative maximum area of metal on either side of the flared entryway portions 48. However, since it is desired to provide a relatively less gripping pressure on the wire 30, as compared with the gripping pressure provided by the foremost jaws 22 and 24, the slot sections 20 are arcuately curved to reduce the metal area on either side of the jaws 26 and 28 as compared with the area of metal on either side of the jaws 22 and 24. To prevent inordinate weakening of the terminal by the presence of the slot sections 20, the slot sections 20 are shown in FIG. 3 as having terminal end portions 50 which are tangent to imaginary lines 53 extending lengthwise of the barrel portion 4. The tangent lines 52 also are diammetrically opposed on said barrel configuration whereby each tangent line is bounded on either side by approximately one-fourth of the circumference of the barrel configuration. A maximum area of metal in either side of the slot sections 50 is thereby provided.

Because of the substantial open widths of the slot sections 20, it is necessary to prevent jamming of the wire 30 in the slot sections 20 as is transferred from the foremost to the tandem set of jaws. In addition, the flared entryway actually enlarges the slot sections 20 adjacent the jaws 40 and 42; thus, shown more particularly in FIG. 6, in conjunction with FIGS. 3, 4, and 5, the foremost set of jaws 10 and 12 are provided with relatively narrow tapered tabs 52.

The narrow tabs 52 project on either side of the longitudinal open seam 8 and into the slot sections 20. The tab portions 52 further project into the enlarged entryway without touching the portions 48. The tab portions 52 laterally support opposite sides of the wires 30 as it passes through the slot sections 20 during transfer from the jaws 22 and 24 to the tandem jaws 26 and 28. The tab portions 42 further guide the wire 30 into the flared entryway and also into the seam 8 between the jaws 26 and 28. As shown in FIG. 2, the wire 30 is longitudinally spaced from the tabs 52 as it is being terminated between the jaws 22 and 24. If the wire is located between the tabs 52 to strengthen the tab portions from damage by the wire 30, they are work hardened by coining. Such coining may change the shape of the tab portions 52 from a sharply tapered configuration as shown in the blank in FIG. 3 to the arcuately curved and tapered configuration shown in FIG. 6.

FIG. 8 illustrates a modification illustrated generally at 54. The contact 56 includes the arcuate slot portions 20 relatively close to the portion 6. Another transverse slot is formed by straight and uncurved slot portions 58 on either side of the open seam 8. A foremost set of wire gripping jaws is formed along the seam 8 between the flared entryway portions 16 and 18 and the slot portions 58. A first tandem set of jaws is formed along the seam 8 between the slot portions 58 and the slot portions 20. A second tandem set of jaws is formed between the slot portions 20 and the portion 6. The first tandem set of jaws is foremost with respect to the second tandem set of jaws. The flared entryway portions 48 are located on all tandem sets of jaws. The tab portions 52 are provided on all foremost sets of jaws. Any combination of straight or curved slot portions can be used. Also the tab portions 52 can be used with any slot, curved or straight.

A further feature of the present invention includes the provision of a cut 60 in the form of a shear or notch in each foremost set of jaws. Each cut 60 serves to prevent removal of an inserted wire terminated to a corresponding set of foremost jaws. More specifically, if a terminated wire should inadvertantly slide upwardly along the seam 8, it will catch in the cut 60 which prevents further motion of the wire.

Although a preferred embodiment of the present invention is described and shows other embodiments and modifications thereof which would be apparent to one having ordinary skill in the art is intended to be covered by the spirit and scope of the appended claims.

What is claimed is:

1. In a stamped and formed electrical contact of metal plate in a barrel configuration and having an open longitudinal wire receiving seam for receipt of one or more wires therein, and a traverse slot intersecting said seam and dividing said barrel configuration into a pair of foremost wire gripping jaws and a pair of tandem wire gripping jaws, the improvement comprising:

said transverse slot having a substantial open width, said foremost set of jaws having tab portions on either side of said seam projecting laterally into said open width of said slot, said tandem set of jaws having an enlarged flared entryway communicating with said transverse slot, and said tab portions projecting partially into said flared entryway without engaging said tandem set of jaws.

2. The structure as recited in claim 1, wherein, said improvement further comprises:

said tab portions being work hardened by coining.

3. In an electrical contact of metal plate in a barrel configuration and having an open longitudinal seam for receipt of one or more wires therein, and a transverse slot intersecting said seam and dividing said barrel configuration into tandem pairs of wire gripping jaws, the improvement comprising:

tab portions on a foremost set of jaws projecting laterally into said slot toward a tandem set of jaws, said tab portions being on either side of said seam thereby to guide a wire along said seam past said slot for insertion between said tandem set of jaws.

4. The structure of claim 3, wherein said improvement further comprises:

said tab portions being coined.

5. The structure as recited in claim 3, wherein, said foremost set of jaws is provided with notch portions opposing each other and communicating with said seam to prevent removal of a wire from said seam by catching said wire and limiting movement of said wire along said seam.

6. In a stamped and formed electrical contact of metal plate in a barrel configuration and having an open longitudinal seam for receipt and electrical connection of one or more electrical wires therein, and a transverse slot intersecting said seam and dividing said barrel configuration into a foremost pair and a tandem pair of wire gripping jaws, the improvement comprising:

said transverse slot intersecting said longitudinal seam, perpendicular adjacent said tandem jaws, and extending continuously away from said longitudinal seam in opposite directions along paths which are nonlinear when said metal plate is either flat or in said barrel configuration.

7. The structure as recited in claim 6, wherein said foremost pair of said jaws includes opposed notch portions communicating with said seam to prevent removal of a wire from said seam by catching and limiting movement of said wire along said seam.

* * * * *